US005214994A

United States Patent [19]

Engel

[11] Patent Number: 5,214,994

[45] Date of Patent: Jun. 1, 1993

[54] SEAL RING WITH ATTACHED BIASING MEANS

[75] Inventor: William K. Engel, Peoria, Ill.

[73] Assignee: Caterpillar Inc., Peoria, Ill.

[21] Appl. No.: 821,421

[22] Filed: Jan. 15, 1992

[51] Int. Cl.[5] ..... F01B 13/04

[52] U.S. Cl. ..... 91/6.5; 91/485; 277/40; 277/87; 277/159

[58] Field of Search ..... 91/485, 6.5, 486, 487; 277/30, 98, 100, 93 SD, 40, 175, 159, 93 R, 87

[56] References Cited

U.S. PATENT DOCUMENTS

| | | | |
|---|---|---|---|
| 661,384 | 11/1900 | Prendergast | 277/100 X |
| 2,972,961 | 2/1961 | Clark | 91/485 X |
| 3,808,950 | 5/1974 | Davies | 91/487 |
| 4,007,663 | 2/1977 | Nagatome et al. | 91/6.5 |
| 4,201,117 | 5/1980 | Gherner | 91/499 |
| 4,481,867 | 11/1984 | Nagase et al. | 91/487 |

OTHER PUBLICATIONS

Publication—"Fluid Power by Delavan", Dated: Circa 1964, By: Delavan Manufacturing Company.

*Primary Examiner*—Richard A. Bertsch
*Attorney, Agent, or Firm*—Loyal O. Watts

[57] ABSTRACT

The design and construction of seals located between a cylinder barrel and a barrel plate rotatable therewith for axial piston fluid translating units have caused an increase in overall unit size, increased stiffness between the barrel and barrel plate and an increase in manufacturing cost and complexity. The present invention overcomes these problems by providing an axially compact, combined circumferential and axial face seal means. The seal means includes an annular seal ring having a sealing end and a biasing end with the sealing end defining an annular seal face of a predetermined width. A biasing means is attached to the biasing end of the seal ring and includes a spring ring having a generally flat base plate with a plurality of resilient fingers angularly extending therefrom. The axially compact structure of the seal means of this invention provides the required flexibility between the barrel and barrel plate while reducing overall unit size, and cost and complexity of manufacturing.

9 Claims, 2 Drawing Sheets

Fig. 1.
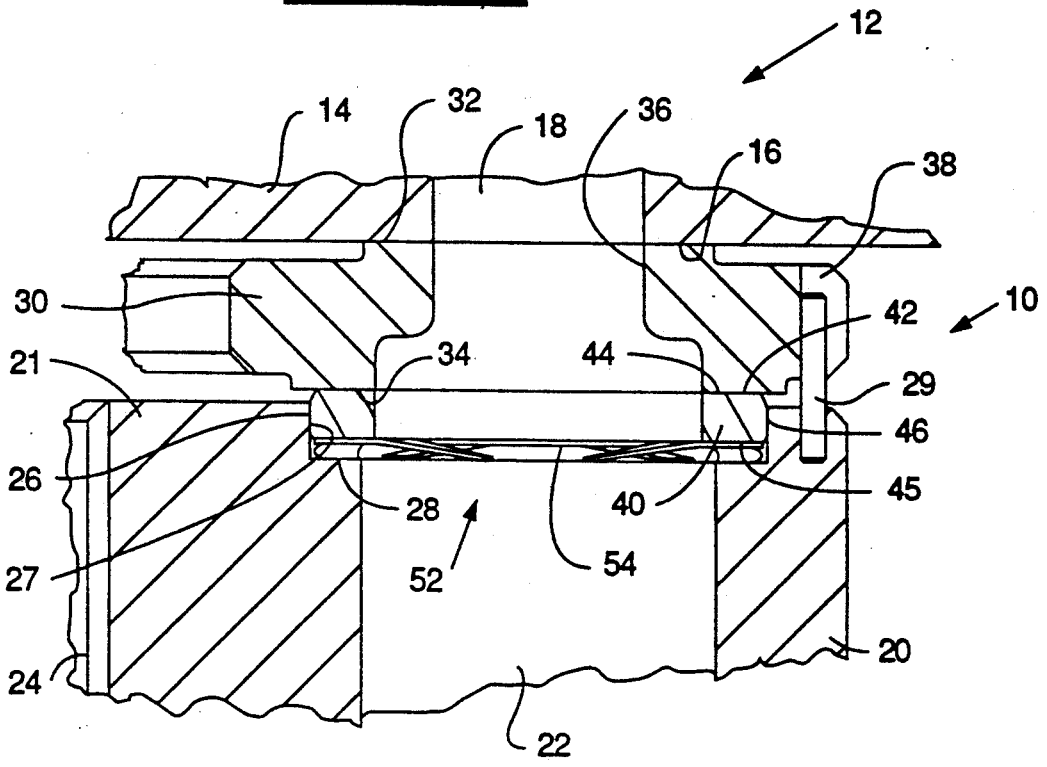
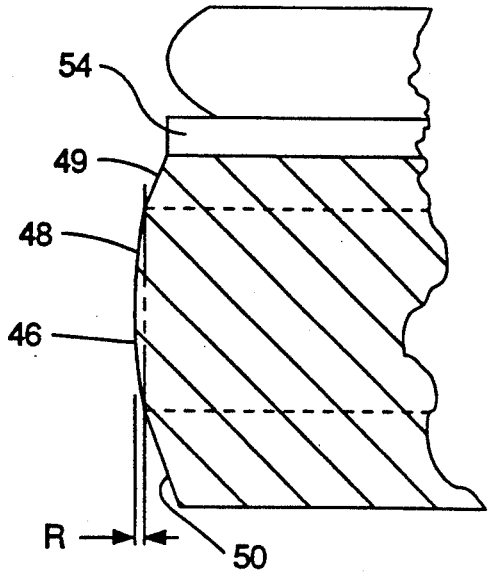
Fig. 4.

SEAL RING WITH ATTACHED BIASING MEANS

DESCRIPTION

1. Technical Field

This invention relates generally to a seal ring for fluid conducting, relatively moveable members and more particularly to a seal ring with combined circumferential and face sealing capabilities.

2. Background Art

The problems associated with sealing a fluid conducting passage through relatively moveable members are well known. For example, in axial, multiple piston pumps and motors it is common to provide a barrel plate or port plate rotatable with the pump or motor barrel and for face sealing engagement with a porting surface which allows ingress and egress of fluid to the pump or motor. The barrel plate is normally axially, slightly spaced from the delivery end of the barrel so that it's relationship to the porting surface is not affected by tilting of the barrel which occurs in devices of this type.

Sealing between the end of the barrel and the facing surface of the barrel plate presents several problems. First, the seal ring must have an effective circumferential sealing relationship with the barrel which allows the seal ring to maintain a parallel, face sealing relation to the barrel plate when the barrel is tilted. Second, the seal ring must be axially compact, both for the reason last described and to minimize unusable axial space between the piston and the porting surface, as well as the quantity of fluid contained therein, when the piston is in a top or uppermost position. Third, the biasing means for the seal should not enlarge radially when compressed axially. Such radial growth would require more space in the area of the seal and a radially wider engagement shoulder to allow for the radial growth. It is also important that the seal should be simple and economical to manufacture and assemble.

The following U.S. patents teach various structures related to sealing between a pump or motor cylinder barrel and a barrel plate rotatable therewith; U.S. Pat. No. 3,808,950, issued May 7, 1974 to Anthony R. Davis; U.S. Pat. No. 4,007,663, issued Feb. 15, 1977 to Kuniyasu Nagatomo et al; U.S. Pat. No. 4,201,117, issued May 6, 1980 to Lidio Gherner, and U.S. Pat. No. 4,481,867, issued Nov. 13, 1984 to Yukihiko Nagase, et al. Exhibit A, a publication by Delavan Manufacturing Company, Circa 1964, discloses a sealing structure between a barrel and a port plate rotatable therewith for a fluid translating unit.

All of the structures disclosed in the above listed publications are deficient with respect to solving one or more of the above described problems in an effective and economical manner.

DISCLOSURE OF THE INVENTION

In one aspect of the present invention, a seal means adapted for axial face sealing relation to a first member and a circumferential sealing relation to a second member is provided, the seal means comprises an annular seal ring having a sealing end and a biasing end. An annular seal face of a predetermined width is defined at the sealing end of the annular seal ring. A circumferential seal surface of a predetermined useable length is defined on the outer periphery of the annular seal ring. A biasing means is attached to the biasing end of the annular seal ring. The biasing means includes a spring ring having a generally flat annular base plate having a plurality of resilient fingers angularly extending therefrom.

BRIEF DESCRIPTION OF THE DRAWINGS

FIG. 1 is fragmentary cross sectional view of a portion of an axial piston fluid translating unit including an embodiment of the seal means of the present invention;

FIG. 4 is an enlarged, fragmentary, cross-sectional view of the seal means of the present invention.

BEST MODE FOR CARRYING OUT THE INVENTION

Figure 2:
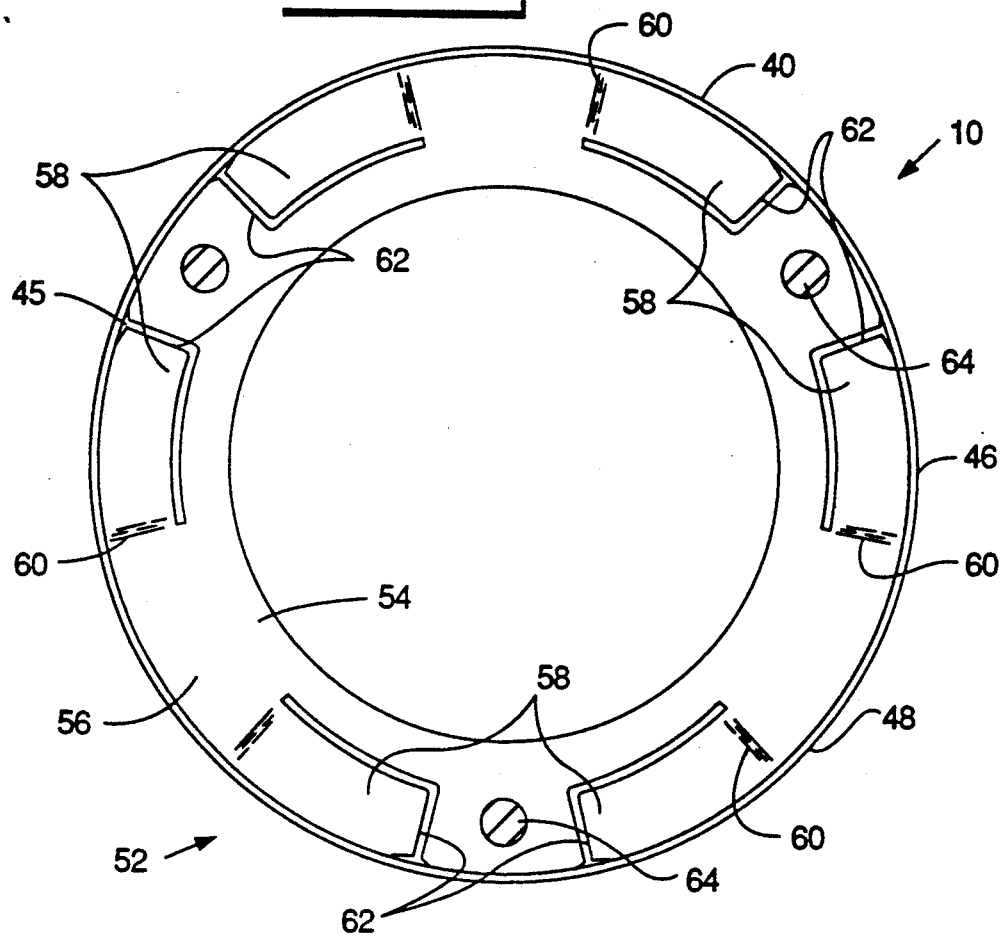
FIG. 2 is an enlarged plan view of the seal means of FIG. 1.
Figure 3:
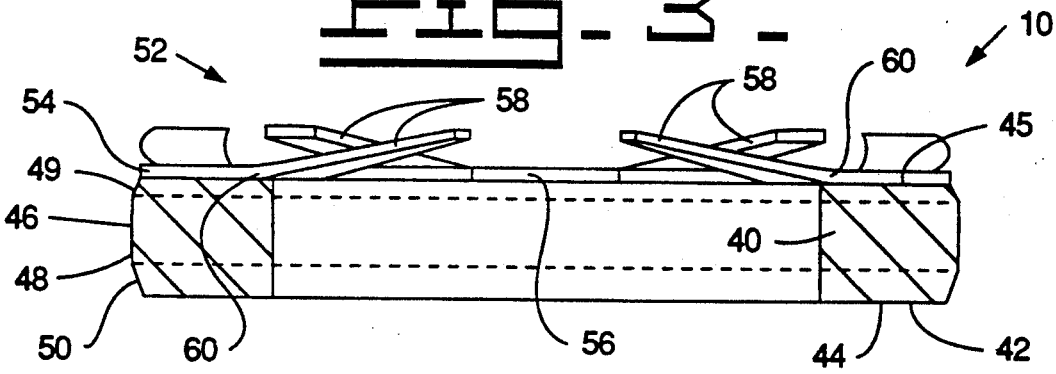
FIG. 3 is a partial cross sectional view of the seal means of the present invention taken along the line 2—2 of FIG. 2.

Referring now to FIGS. 1, 2, and 3, an embodiment of a seal means 10 is disclosed in conjunction with fragmentary portions of an axial piston fluid translating unit 12. The fluid translating unit 12 includes a first member, in the form of a head or port plate, a portion of which is shown at 14. The head 14 includes a porting surface 16 and an intake-output port 18 communicating between the porting surface 16 and the exterior of the fluid translating unit.

A second member or cylinder barrel, a portion of which is shown at 20, is disposed in the fluid translating unit 12 and includes an intake-output end 21 in axially spaced facing relation to the porting surface 16 of the head 14. The barrel 20 also defines a plurality of cylinder bores, only one of which is shown at 22, and a central bore 24 to accept a shaft, not shown, for connection therewith in any conventional manner. The barrel further defines a counterbore 26 in the intake-output end 21 thereof in circumscribing relation to the cylinder bore 22. The counterbore26, with the barrel, defines an inner peripheral surface 27 and a shoulder 28. A pin 29 is secured in and protrudes from the intake-output end 21 of the barrel toward the porting surface, for purposes herein after described.

A annular barrel plate 30 is interposed the porting surface 16 of the head and the intake-output end 21 of the barrel. The barrel plate 30 includes a first annular sealing surface 32 disposed in face sealing engagement with the porting surface 16 of the head 14. The barrel plate further includes a second annular sealing surface 34 disposed in slightly spaced relation to the intake-output end 21 of the barrel 20. A fluid port 36 extends axially through the barrel plate in generally axial alignment with the cylinder bore 22 and in communication with the port 18. The barrel plate also defines a notch 38 in alignment with the pin 29 for engagement thereof to cause the barrel plate to rotate with the barrel.

The seal means 10 includes an annular seal ring 40 disposed in the counterbore 26 in the barrel 20. The seal means, as best shown in FIGS. 2, 3, and 4 has a sealing end 42 which defines an annular seal face 44 having a predetermined width which, in this example, is approximately 3.18 millimeters and an axially opposite biasing end 45. The axial length of the seal ring 30 is no greater than the radial width of the annular seal face 44. The seal ring 40 includes a spherical outer periphery 46 defining a circumferential sealing surface 48 of a predetermined useable length 46. The spherical sealing surface has a rise R and is adapted to be disposed in circumferential sealing relation to the inner peripheral surface 27 of the counterbore 26. The outer periphery 46 of the seal ring defines a first chamfer 50 adjacent the sealing end and a second chamfer 49 adjacent the biasing end thereof which establishes the predetermined length of the circumferential sealing surface 48, as is best shown in FIGS. 2 and 3. In this specific embodiment, the first chamfer 50 is larger than the second chamfer 49. It is also recognized that the outer periphery 46 may be cylindrical with the circumferential sealing surface 48 having a predetermined length of approximately 1.0 millimeter. The narrow sealing surface 48 may be achieved by enlarging the chamfers 49,50. In this application, the predetermined useable length of the sealing surface 48 is no greater than the predetermined width of the annular sealing face 44. In this specific example, the predetermined length of the circumferential sealing surface 48 is less than the predetermined width of the annular seal face 44. Although any suitable material may be used, in this application the seal rings are made from SAE 52100 through hardenable steel and are direct hardened by quenching from a suitable temperature and then tempering.

The seal means 10 also includes a biasing means 52 for urging the seal ring toward the barrel plate 30 and which is disposed in the counterbore 26 between the biasing end 45 of the seal ring 40 and the shoulder 28 of the counterbore 26. The biasing means 52 includes a spring ring 54 having an axial length no greater than the axial length of the seal ring 40. In this application, the spring ring is made from any suitable spring steel and includes a generally flat base plate 56 having a plurality of resilient fingers 58 extending angularly therefrom and axially away from the biasing end 45 of the seal ring 40. In this instance, each of the resilient fingers 58 have a fixed end 59 which is integral with the base plate 56 and are bent outwardly at a juncture 60 therewith to extend angularly therefrom, at an angle within a range of 10 to 15 degrees, to a free end 62. The resilient fingers 58 also extend circumferentially from the juncture 60 and, in the precise example shown, are confined entirely with in the outer circumferential confines of the generally flat base plate 56. With this structure, compression of the resilient fingers 58 does not cause any radial growth of the spring ring 40 thus allowing it to be snugly fitted in the counterbore 26.

In this application, the annular metallic spring ring 54 is attached to the seal ring 40 by a plurality of spot welds 64. It is also recognized that the annular metallic spring ring 54 may be attached to the seal rings 40 in any suitable manner such as by adhesive bonding, brazing, etc. The annular metallic spring ring 54, as specifically taught in this application, is formed from a stainless spring steel.

INDUSTRIAL APPLICABILITY

In use, the seal means 10 is placed in the counterbore 26 with the biasing means in contact with the shoulder 28. The resilient fingers are compressed during assembly to urge or bias the seal ring 40 into face sealing engagement with the second annular surface 34 of the barrel plate 30. When the barrel 20 and barrel plate 30 are rotating relative to the head 14 the seal ring 40 is held in sealing engagement with the second annular surface 34 by the spring ring 54 as well as by fluid pressure in the cylinder bore 22 acting on the biasing end 45.

Due to high pressure in the fluid translating unit and the pistons operating in different planes the barrel 20 will, at times, tilt relative to the porting surface 16 due to bending of the shaft (not shown), as is well known in the industry. Since the barrel plate 30 is not connected to the translating unit shaft, the tilting forces are not imposed thereon. As a result, it is necessary that the seal means 10 allow barrel tilting while remaining in parallel, face sealing relation to the second annular sealing surface 34 of the barrel plate 30. The seal ring 40 is permitted to tilt within the counterbore 26 due to the spherical outer periphery 46 or the relatively short length of a cylindrical sealing surface 48. This allows the seal ring 40 to remain in parallel face sealing relation to the second annular sealing surface 34 when the barrel 20 is tilted.

The diametrical clearance of the circumferential seal surface 48 to the inner peripheral surface 27 of the counterbore 26 is, in one specific example, 0.00762 millimeter or less. This very close tolerance is sufficient to provide a high integrity seal to minimize, if not eliminate, fluid leakage at that point while still allowing tilting of the seal ring in the counterbore.

The axially compact structure of the seal means 10, including the seal ring 40 and the biasing means 52, minimizes the space utilized thereby, as well as the quantity of fluid contained between the end of the translating unit piston and the porting surface 16.

The angularly and circumferentially extending resilient fingers 58 allow axial compression during assembly without causing radial growth of the seal ring 40. This advantageously allows snug radial fitting of the seal ring 40 in the counterbore 26 to minimize the radial width of the counterbore.

The above described problems are solved by the provision of the seal means 10 of the present invention. The seal means is adapted for axial face sealing relation to a first member and circumferential sealing relation to a second member. The seal means 10 includes a seal ring 40 and a biasing means 52. The seal ring 40 defines a sealing end having a predetermined width and a biasing end 45 with the outer periphery defining a circumferential sealing surface 48 of a predetermined length. The biasing means 52 is attached to the biasing end of the seal ring 40 and includes a spring ring 54 having a generally flat annular base plate 56 with a plurality of resilient fingers 58 angularly and extending therefrom.

Other aspects, objects and advantages of this invention can be obtained from a study of the drawings, the disclosure, and the appended claims.

I claim:

1. A seal means adapted for axial face sealing relation to a first member and circumferential sealing relation to a second member, comprising:

an annular seal ring having an outer periphery, a sealing end and an axially opposite biasing end, an annular seal face of a predetermined width defined at the sealing end of the ring and a circumferential sealing surface of a predetermined useable length defined on the outer periphery thereof with the predetermined useable length of the circumferential sealing surface being no greater than the predetermined width of the annular seal face, and biasing means attached to the biasing end of the annular seal ring, the biasing means including a spring ring having a generally flat annular base plate having a plurality of resilient fingers angularly extending therefrom.

2. The seal means of claim 1 wherein the plurality of resilient fingers each have a fixed end and a free end with the fixed end being integral with the generally flat annular base plate of the spring ring at a juncture therewith and the resilient fingers are bent at the juncture to extend angularly from the generally flat base plate and axially away from the biasing end of the seal ring.

3. The seal means of claim 2 wherein the resilient fingers extend circumferentially from the generally flat base plate and are contained entirely within the outer circumferential confines of the base plate.

4. The seal means of claim 3 wherein the axial length of the biasing means is no greater than the predetermined axial length of the seal ring.

5. The seal means of claim 4 wherein the outer periphery and the circumferential sealing surface of the seal ring is spherical.

6. The seal means of claim 5 wherein the outer periphery of the annular seal ring includes a first chamfer adjacent the sealing end of the annular seal ring and a second chamfer adjacent the biasing end thereof.

7. The seal means of claim 6 wherein the first chamfer is larger than the second chamfer.

8. The seal means of claim 4 wherein the annular seal ring is metal.

9. The seal means of claim 8 wherein the spring ring is metal.

* * * * *